US008836582B2

(12) United States Patent
Wong et al.

(10) Patent No.: US 8,836,582 B2
(45) Date of Patent: Sep. 16, 2014

(54) MOBILE COMMUNICATION DEVICE AND ANTENNA STRUCTURE THEREIN

(75) Inventors: Kin-Lu Wong, New Taipei (TW); Shu-Chuan Chen, New Taipei (TW)

(73) Assignee: Acer Incorporated, Xizhi Dist., New Taipei (TW)

( * ) Notice: Subject to any disclaimer, the term of this patent is extended or adjusted under 35 U.S.C. 154(b) by 539 days.

(21) Appl. No.: 13/109,994

(22) Filed: May 17, 2011

(65) Prior Publication Data

US 2012/0218151 A1 Aug. 30, 2012

(30) Foreign Application Priority Data

Feb. 25, 2011 (TW) ..... 100106389 A

(51) Int. Cl.

| | |
|---|---|
| ***H01Q 1/38*** | (2006.01) |
| ***H01Q 9/42*** | (2006.01) |
| ***H01Q 5/00*** | (2006.01) |
| ***H01Q 1/24*** | (2006.01) |

(52) U.S. Cl.

CPC ..... *H01Q 1/243* (2013.01); *H01Q 9/42* (2013.01); *H01Q 5/0058* (2013.01); *H01Q 5/0068* (2013.01); *H01Q 1/38* (2013.01)

USPC ..... 343/700 MS; 343/700 R

(58) Field of Classification Search

USPC ..... 343/700 MR, 700 R, 829, 830

See application file for complete search history.

(56) References Cited

U.S. PATENT DOCUMENTS

| | | | | |
|---|---|---|---|---|
| 7,102,572 | B2 | 9/2006 | Okado | |
| 2002/0163470 | A1 | 11/2002 | Nagumo | |
| 2008/0174496 | A1 * | 7/2008 | Hsu et al. | 343/700 MS |
| 2009/0256754 | A1 * | 10/2009 | Tsai et al. | 343/700 MS |
| 2011/0028191 | A1 * | 2/2011 | Huang et al. | 455/575.7 |

FOREIGN PATENT DOCUMENTS

| | | | |
|---|---|---|---|
| CN | 1392632 | A | 1/2003 |
| CN | 1617387 | A | 5/2005 |
| EP | 1 267 440 | A2 | 12/2002 |
| EP | 1 267 440 | A3 | 4/2004 |
| TW | 200812147 | | 3/2008 |
| TW | 1327786 | | 7/2010 |

OTHER PUBLICATIONS

Wei-Yu Li et al., "Internal penta-band printed loop-type mobile phone antenna" TENCON 2007-2007 IEEE Region 10 Conference Publication Year: 2007, pp. 1-4.

* cited by examiner

*Primary Examiner* — Michael G Lee
*Assistant Examiner* — Matthew Mikels
(74) *Attorney, Agent, or Firm* — Winston Hsu; Scott Margo

(57) ABSTRACT

A mobile communication device having an antenna structure includes a grounding element and an antenna element. The antenna element includes an antenna ground plane, a radiation portion, and a shorted radiation portion, wherein the antenna ground plane is grounded to the grounding element. The radiation portion includes a signal feeding point, a first radiation section, and a second radiation section. First and second radiation sections are connected to the signal feeding point, and are extended toward the same direction. First end of the shorted radiation portion is electrically connected to the antenna ground plane, and second end is left open. There is a coupling gap between a designated section of the radiation portion close to the first end and the shorted radiation portion. Through the coupling gap, the shorted radiation portion is capacitively excited by the radiation portion and generates at least one resonant mode to increase antenna's operating bandwidth.

18 Claims, 4 Drawing Sheets

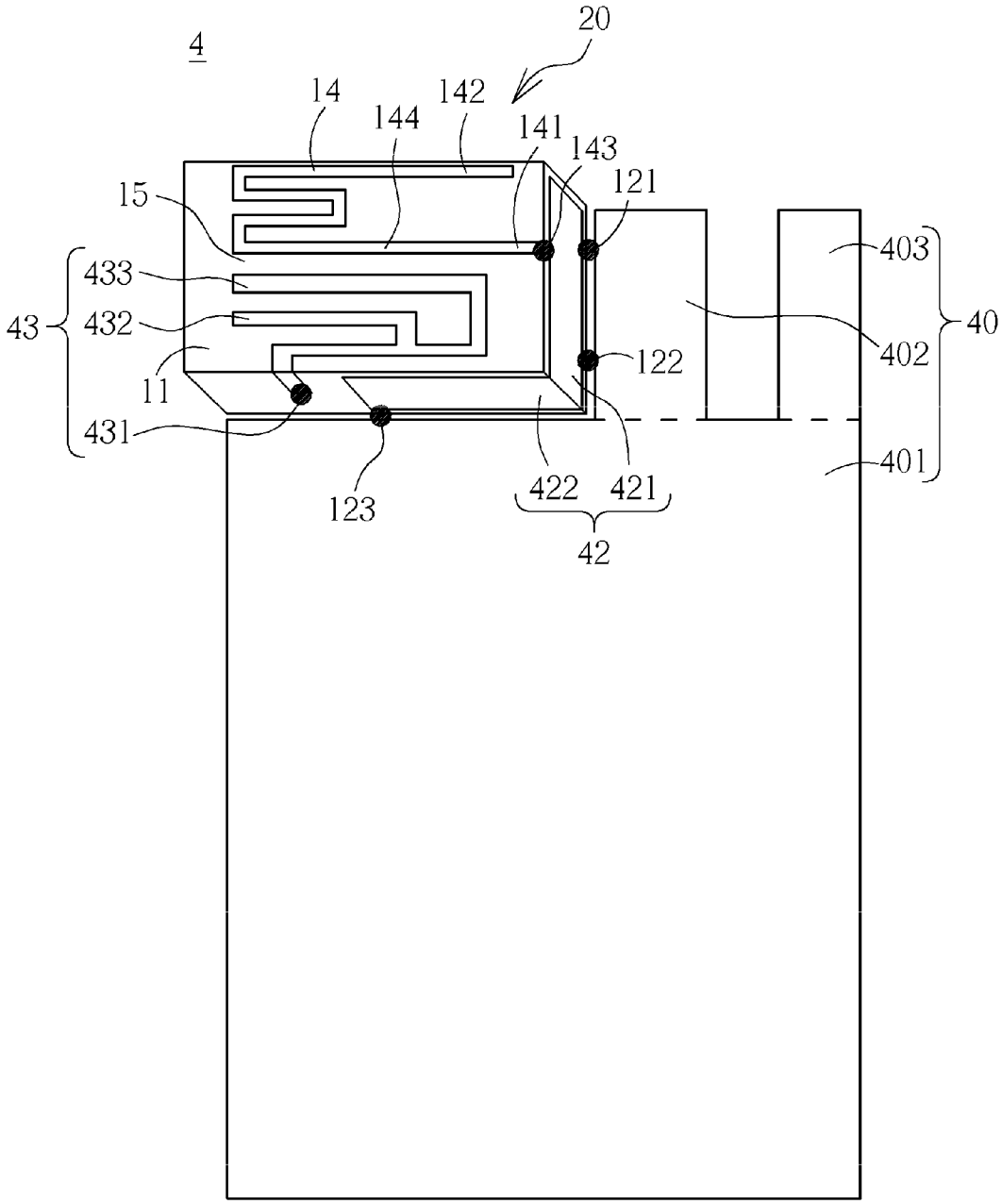
FIG. 4
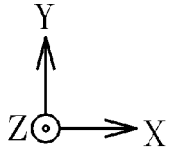

MOBILE COMMUNICATION DEVICE AND ANTENNA STRUCTURE THEREIN

BACKGROUND OF THE INVENTION

1. Field of the Invention

The present invention relates to a mobile communication device and an antenna structure therein, and more particularly, to a mobile communication device with a built-in antenna having a shielding metal wall and multi-frequency operating bands.

2. Description of the Prior Art

With the rapid progress of wireless technology, the long term evolution (LTE) mobile technology has been promoted. Antennas of mobile communication devices are required to have lower operating frequencies and wider bandwidths, that is, their operating bands must cover from about 704 MHz to 960 MHz and from about 1710 MHz to 2690 MHz so as to satisfy the three-band LTE700/2300/2500 operation and the five-band WWAN operation. Mobile communication devices are required to be light and small, such that small size and multi-band operations become essential design considerations. Furthermore, under multi-functional demands, the integration of an internal antenna and other electronic elements on the system circuit board of the mobile communication device is increasing. Hence, how to design a multi-frequency antenna with a shielding metal wall to effectively perform the integration of the antenna and other electronic elements on the system circuit board of the mobile communication device and satisfying the wideband operation has become an important topic in this field.

In the prior art, such as TW patent No. 1327786 with the invention entitled "AN EMC INTERNAL MEANDERED LOOP ANTENNA FOR MULTIBAND OPERATION", a multiband meandered loop antenna having a meandered loop radiator for multiband operation integrated with an antenna ground plane acted as a shielding metal wall has been disclosed. Such multiband meandered loop antenna has an operating band covering the five-band WWAN operation, however, its operating band cannot cover the eight-band LTE/WWAN operation.

Hence, how to provide a mobile communication device with the wide operating band at least covering from about 704 MHz to 960 MHz and from about 1710 MHz to 2690 MHz to satisfy the eight-band LTE/WWAN operation and perform the integration of an internal antenna and other electronic elements on the system circuit board of the device has become an important topic in this field.

SUMMARY OF THE INVENTION

In order to solve the abovementioned problems, it is one of the objectives of the present invention to provide a mobile communication device and a related antenna structure covering the eight-band LTE/WWAN operation and having a shielding metal wall to effectively perform the integration of its built-in antenna with electronic elements of the mobile communication device.

According to an aspect of the present invention, a mobile communication device comprising an antenna structure is provided. The antenna structure includes a grounding element and an antenna element, wherein the antenna element is disposed in one side of the grounding element. The antenna element may include an antenna ground plane, a radiation portion, and a shorted radiation portion, wherein the antenna ground plane is electrically connected to the grounding element. The radiation portion and the shorted radiation portion are disposed on a substrate. The radiation portion may include a signal feeding point, a first radiation section, and a second radiation section. The signal feeding point is disposed on one end close to the grounding element. The first and second radiation sections are connected to the signal feeding point, open ends of the first and second radiation sections are extended toward the same direction, and the first radiation section and the second radiation section provide two resonant paths with different lengths and extended toward the same direction in order to generate at least two resonant modes to increase the operating bandwidth of the antenna element. A length of the shorted radiation portion is at least twice the shortest resonant path. A first end of the shorted radiation portion is electrically connected to the antenna ground plane, and a second end of the shorted radiation portion is an open end, wherein there is a coupling gap between a designated section of the shorted radiation portion close to the first end and the radiation portion, and through the coupling gap, the shorted radiation portion is capacitively excited by radiation portion and generates at least one resonant mode to increase an operating bandwidth of the antenna element. The antenna element is a three-dimensional structure, and the antenna ground plane and the radiation portion are located on different planes of the three-dimensional structure.

According to another aspect of the present invention, an antenna structure is provided. The antenna structure includes a grounding element and an antenna element, wherein the antenna element is disposed in one side of the grounding element. The antenna element may include an antenna ground plane, a radiation portion, and a shorted radiation portion, wherein the antenna ground plane is electrically connected to the grounding element. The radiation portion and the shorted radiation portion are disposed on a substrate. The radiation portion may include a signal feeding point, a first radiation section, and a second radiation section. The signal feeding point is disposed on one end close to the grounding element. The first and second radiation sections are connected to the signal feeding point, open ends of the first and second radiation sections are extended toward the same direction, and the first radiation section and the second radiation section provide two resonant paths with different lengths and extended toward the same direction in order to generate at least two resonant modes to increase the operating bandwidth of the antenna element. A length of the shorted radiation portion is at least twice the shortest resonant path. A first end of the shorted radiation portion is electrically connected to the antenna ground plane, and a second end of the shorted radiation portion is an open end, wherein there is a coupling gap between a designated section of the shorted radiation portion close to the first end and the radiation portion, and through the coupling gap, the shorted radiation portion is capacitively excited by radiation portion and generates at least one resonant mode to increase an operating bandwidth of the antenna element. The antenna element is a three-dimensional structure, and the antenna ground plane and the radiation portion are located on different planes of the three-dimensional structure.

The present invention includes the following advantages. The multiband antenna of the mobile communication device uses its antenna ground plane as a shielding metal wall. In addition, the sections with a strong current (or the sections with a weak electric field) of the radiation portion and the shorted radiation portion are disposed adjacent to the antenna ground plane, such that the multiband operation of the antenna won't be affected by the antenna ground plane, and the internal antenna can be tightly integrated with other electronic elements on the system circuit board of the device. The major design mechanism of the multiband antenna is to use two radiation portions with two different lengths and extended toward the same direction to generate two resonant modes with different center frequencies at the higher frequencies, such that these two resonant modes can cover most bandwidth of the second (higher frequency) operating band. Moreover, the extended direction of the radiation portion keeps the open end of the radiation portion away from the antenna ground plane. By using a coupling gap between the designated section of the shorted radiation portion close to the shorting end and the radiation portion, the shorted radiation portion can be excited. Be noted that: the coupling gap is less than 3 mm, and the length of the shorted radiation portion is at least twice the shortest resonant path of the radiation portion, such that the energy of the radiation portion can be coupled to the shorted radiation portion in order to effectively excite the shorted radiation portion. As a result, the first (lower-frequency) operating band covering the three-band LTE700/GSM850/900 operation (from about 704 MHz to 960 MHz) can be formed, and another higher-order resonant mode can be excited at the higher frequencies. Then, the higher-order resonant mode can be combined with the resonant mode excited by the radiation portion in order to form a wideband second (higher-frequency) operating band at least covering the five-band GSM1800/1900/UMTS/LTE2300/2500 operation (from about 1710 MHz to 2690 MHz) to satisfy the eight-band LTE/WWAN operation, which can satisfy requirements of covering operating bands of all mobile communication systems at present. Furthermore, since the multiband antenna of the mobile communication device has a small size of $3\times15\times35$ mm$^3$ and a shielding metal wall, and can be easily integrated with neighboring components, it can satisfy requirements of practical applications.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 4 is a diagram illustrating a mobile communication device and an antenna structure disposed therein according to a third embodiment of the present invention.

DETAILED DESCRIPTION

The following description is of the best-contemplated mode of carrying out the present invention. A detailed description is given in the following embodiments with reference to the accompanying drawings.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
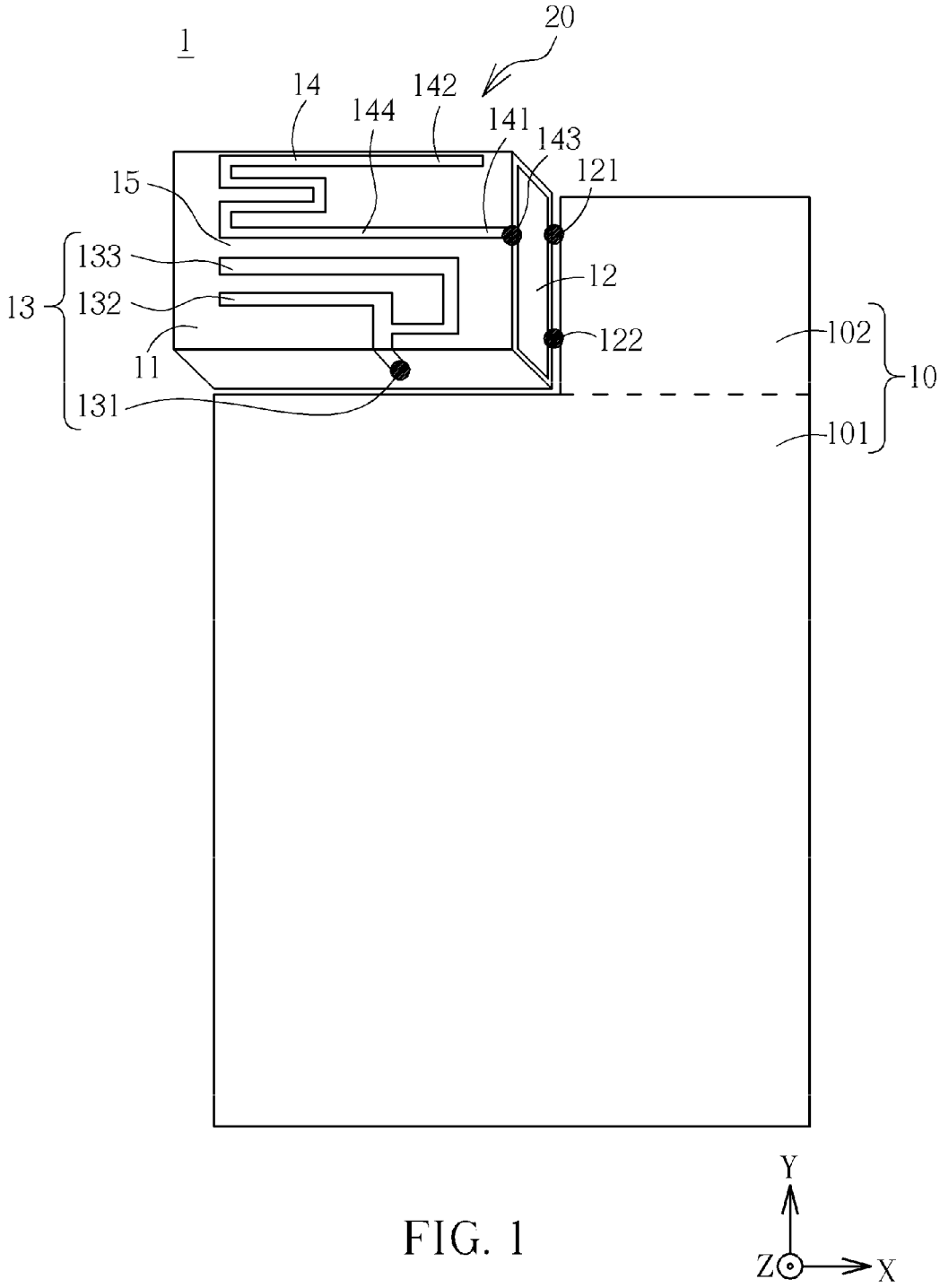
FIG. 1 is a diagram illustrating a mobile communication device and an antenna structure disposed therein according to a first embodiment of the present invention.

Please refer to FIG. 1. FIG. 1 is a diagram illustrating a mobile communication device 1 and an antenna structure disposed therein according to a first embodiment of the present invention. As shown in FIG. 1, the mobile communication device 1 includes an antenna structure, wherein the antenna structure may include a grounding element 10 and an antenna element 20. In this embodiment, the grounding element 10 may include a main ground 101 and a protruded ground 102, wherein the protruded ground 102 is electrically connected to an edge of the main ground 101, and the protruded ground 102 and the main ground 101 substantially form an L shape. This is presented merely to illustrate a practicable design of the present invention, and in no way should be considered to be limitations of the scope of the present invention.

In addition, the antenna element 20 is disposed in one side of the grounding element 10, and the antenna element 20 may include an antenna ground plane 12, a radiation portion 13, and a shorted radiation portion 14. In this embodiment, the radiation portion 13 and the shorted radiation portion 14 of the antenna element 20 are disposed on a substrate 11. The antenna ground plane 12 is located on one side of the grounding element 10 and is electrically connected to the grounding element 10 through two shorting points 121 and 122. What calls for special attention is that: the antenna element 20 is a three-dimensional structure, and the antenna ground plane 12 and the radiation portion 13 are located on different planes of the three-dimensional structure. The radiation portion 13 may include a signal feeding point 131, a first radiation section 132, and a second radiation section 133, wherein the signal feeding point 131 is disposed on one end close to the grounding element 10. The first radiation section 132 and the second radiation section 133 are connected to the signal feeding point 131, and open ends of the first second radiation section 132 and the second radiation section 133 are extended toward the same direction. What calls for special attention is that: in this embodiment, the extended direction of the first radiation section 132 of the radiation portion 13 keeps the open end of the first radiation section 132 away from the antenna ground plane 12, and the extended direction of the second radiation section 133 of the radiation portion 13 keeps the open end of the second radiation section 133 away from the antenna ground plane 12. Moreover, a first length of the first radiation section 132 is smaller than a second length of the second radiation section 133. In other words, the first radiation section 132 and the second radiation section 133 of the radiation portion 13 at least provide two resonant paths with different lengths and extended toward the same direction in order to generate at least two resonant modes to increase the operating bandwidth of the antenna element 20.

Furthermore, the shorted radiation portion 14 is disposed on the substrate 11 as well, wherein a first end 141 of the shorted radiation portion 14 is electrically connected to the antenna ground plane 12 through a shorting point 143, and a second end 142 of the shorted radiation portion 14 is an open end. In this embodiment, the shorted radiation portion 14 can be designed to have a plurality of (at least two) bends for reducing the size of the antenna element 20, and the length of the shorted radiation portion 14 is at least twice the shortest resonant path of the radiation portion 13. In other words, the length of shorted radiation portion 14 is at least twice the first length of the first radiation section 132. What calls for special attention is that: there is a coupling gap 15 between a designated section 144 of the shorted radiation portion 14 close to the first end 141 and the radiation portion 13, and through the coupling gap 15, the shorted radiation portion 14 is capacitively excited by the radiation portion 13 and generates at least one resonant mode to increase the operating bandwidth of the antenna element 20. The coupling gap 15 is less than 3 mm.

Please also note that: in the first embodiment, the antenna element 20 and the grounding element 10 of the antenna structure are located on different planes of the three-dimensional space. For example, the radiation portion 13 and the shorted radiation portion 14 of the antenna element 20 are located on a first plane (such as, an XY plane shown in FIG. 1), the antenna ground plane 12 is located on a second plane perpendicular to the first plane (such as, an YZ plane shown in FIG. 1), and the main ground 101 and the protruded ground 102 of the grounding element 10 are located on a third plane being parallel to the first plane and perpendicular to the second plane (such as, another XY plane shown in FIG. 1).

Figure 2:
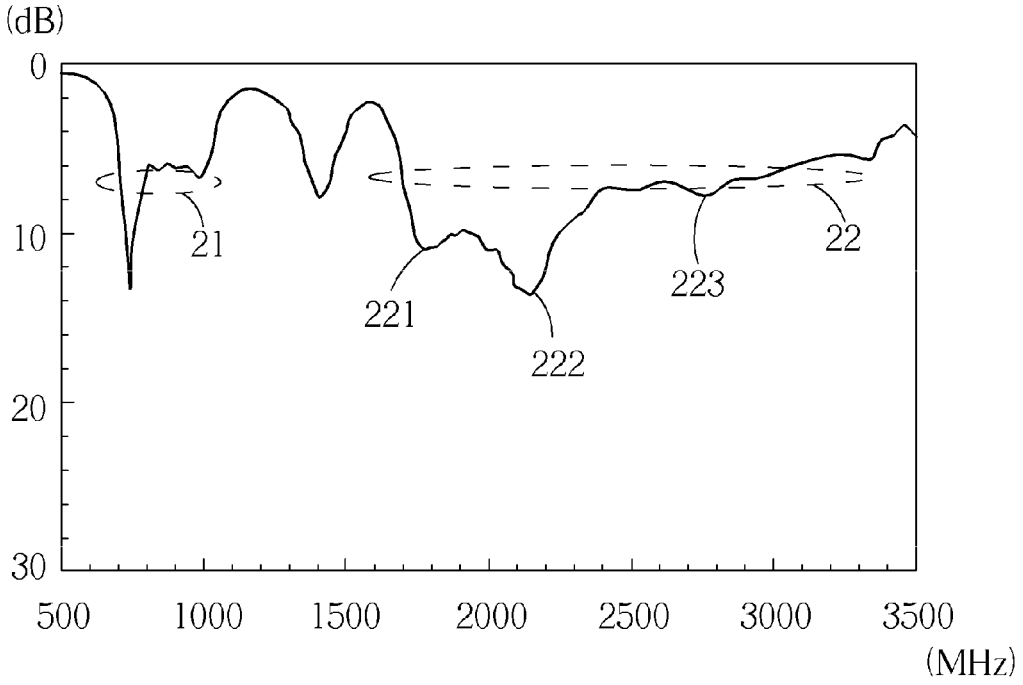
FIG. 2 is a diagram illustrating the return loss of the mobile communication device and the antenna structure disposed therein according to a first embodiment of the present invention.

Please refer to FIG. 2 together with FIG. 1. FIG. 2 is a diagram illustrating the return loss of the mobile communication device and the antenna structure disposed therein according to a first embodiment of the present invention. In this embodiment, the size of the mobile communication device 1 is as follows: the substrate 11 has a length of 35 mm, a width of 15 mm, and a height of 3 mm; the main ground 101 has a length of 100 mm and a width of 60 mm; the protruded ground 102 has a length of 15 mm and a width of 25 mm; the radiation portion 13 and the shorted radiation portion 14 are formed on the substrate 11, wherein the radiation portion 13 includes the first radiation section 132 and the second radiation section 133 for providing two resonant paths, such that two resonant modes 222 and 223 can be respectively excited at the higher frequencies; the shorted radiation portion 14 has a length of 100 mm, wherein the coupling gap 15 between the designated section 144 of the shorted radiation portion 14 close to the first end 141 (i.e., the shorting end) and the radiation portion 13 is about 1 mm. Through the coupling gap 15, a resonant mode can be excited at the lower frequencies to form a first operating bandwidth 21 of the antenna element 20 and a higher-order resonant mode 221 can be excited at the higher frequencies. Then, the higher-order resonant mode 221 can be combined with the two resonant modes 222 and 223 excited by the radiation portion 13 so as to form a second (higher-frequency) operating band 22 of the antenna element 20. According to the experimental results and a 6-dB return-loss definition, the first operating band 21 may cover the three-band LTE700/GSM850/900 operation (from about 704 MHz to 960 MHz), and the second operating band 22 may cover the five-band GSM1800/GSM1900/UMTS/LTE2300/LTE2500 operation (from about 1710 MHz to 2690 MHz), thereby the antenna structure can satisfy requirements of the eight-band LTE/WWAN operation.

Figure 3:
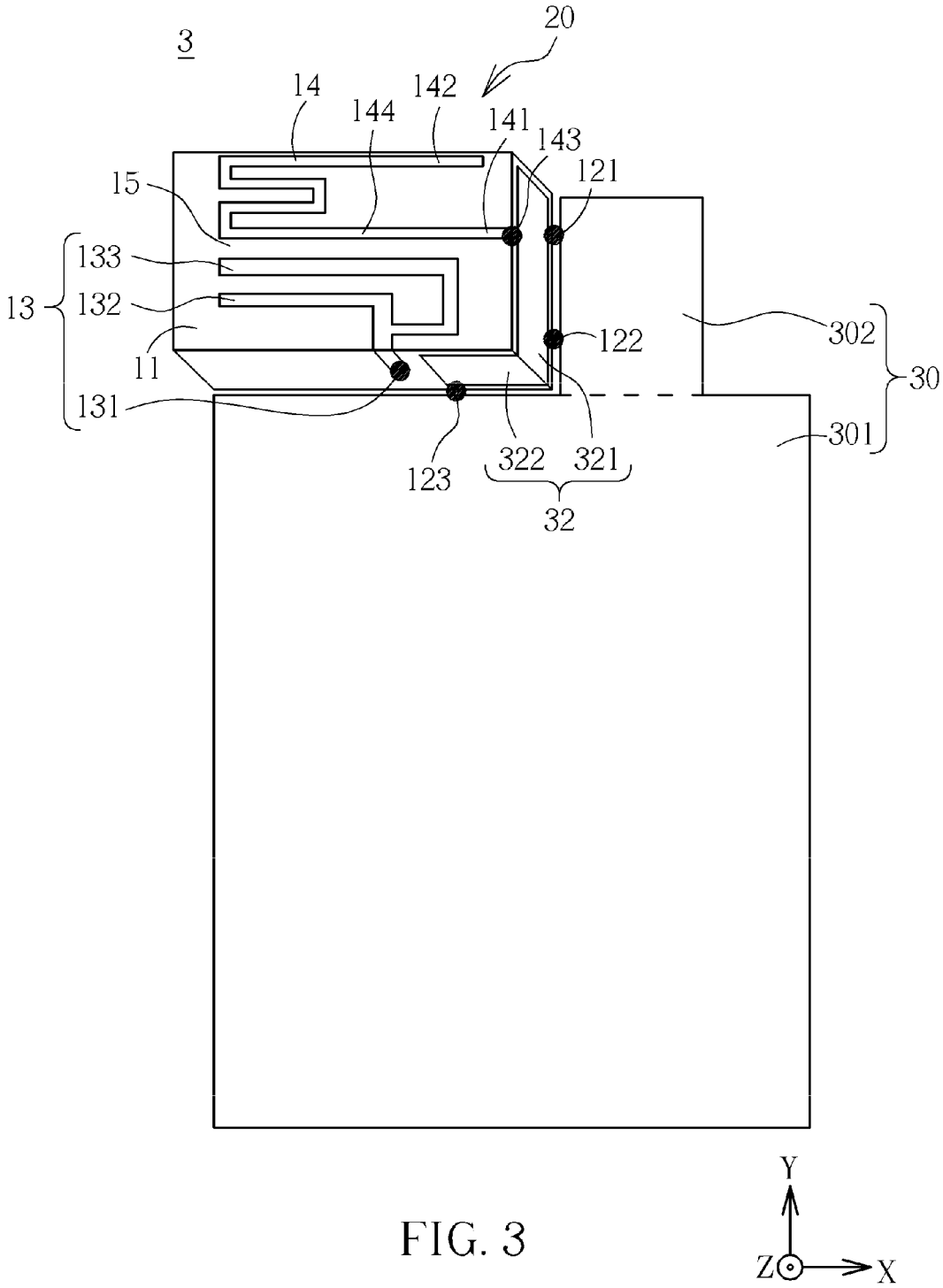
FIG. 3 is a diagram illustrating a mobile communication device and an antenna structure disposed therein according to a second embodiment of the present invention.

Please refer to FIG. 3. FIG. 3 is a diagram illustrating a mobile communication device and an antenna structure disposed therein according to a second embodiment of the present invention. The structure of the mobile communication device 3 shown in the second embodiment is similar to that of the mobile communication device 1 shown in the first embodiment, and the difference between them is that: an antenna ground plane 32 of the mobile communication device 3 shown in FIG. 3 includes a first antenna ground sub-plane 321 and a second antenna ground sub-plane 322 respectively located on two adjacent sides of the antenna element 20, and is electrically connected to the grounding element 20 through shorting points 121, 122, and 123. Moreover, the grounding element 30 of the mobile communication device 3 are composed of a main ground 301 and a protruded ground 302, wherein the main ground 301 and the protruded ground 302 substantially form an convex shape, and the protruded ground 302 is electrically connected to an edge of the main ground 301. Moreover, the structure of the mobile communication device 3 of the second embodiment is similar to that of the mobile communication device 1 of the first embodiment, and forms two similar wideband operating bands covering the eight-band LTE/WWAN operation.

Please refer to FIG. 4. FIG. 4 is a diagram illustrating a mobile communication device 4 and an antenna structure disposed therein according to a third embodiment of the present invention. The structure of the mobile communication device 4 shown in the third embodiment is similar to that of the mobile communication device 1 shown in the first embodiment, and the difference between them is that: an antenna ground plane 42 of the mobile communication device 4 shown in FIG. 4 includes a first antenna ground sub-plane 421 and a second antenna ground sub-plane 422 respectively located on two adjacent sides of the antenna element 20, and is electrically connected to the grounding element 40 through shorting points 121, 122, and 123. Moreover, the grounding element 40 of the mobile communication device 4 are composed of a main ground 401 and two protruded grounds 402 and 403, wherein these two protruded grounds 402 and 403 are electrically connected to an edge of the main ground 401. What calls for special attention is that: the signal feeding point 43 of the radiation portion 43 can be slightly adjusted due to the extension of the antenna ground plane 42. Moreover, the structure of the mobile communication device 4 of the third embodiment is similar to that of the mobile communication device 1 of the first embodiment, which can excite two resonant modes with two different center frequencies and their shorted radiation portions have similar structures. Therefore, the mobile communication device 4 of the third embodiment can form two similar wideband operating bands covering the eight-band LTE/WWAN operation.

Please note that: in the embodiments above, the protruded ground 102/302/402 can be further used for accommodating an electronic element functioning as a data transmission port of the mobile communication device 1/3/4, such that the electronic element can provide a signal transmission interface for communicating the mobile communication device 1/3/4 with an external equipment. The abovementioned electronic element functioning as a data transmission port can be implemented by a USB connector, but this in no way should be considered as a limitation of the present invention. Be noted that: the electronic element functioning as a data transmission port and the antenna element 20 can be disposed on the same surface of the protruded ground 102/302/402; or the electronic element functioning as a data transmission port can be disposed on another surface of the protruded ground 102/302/402 opposite to the surface where the antenna element 20 is located thereon, which also belongs to the scope of the present invention.

Undoubtedly, those skilled in the art should appreciate that various modifications of the mobile communication devices and the antenna structures shown in FIG. 1, FIG. 3, and FIG. 4 may be made without departing from the spirit of the present invention. In addition, the number of the bends of the radiation portion is not limited, and the bending direction, the bending angle, and the bending shape of the bends should not be considered as a limitation of the present invention.

The abovementioned embodiments are presented merely to illustrate practicable designs of the present invention, and in no way should be considered to be limitations of the scope of the present invention. In summary, a mobile communication device and its antenna structure are provided, which include an antenna capable of forming two wide operating bands. Such antenna has a simple structure as well as a shielding metal wall suitable for effectively performing the integration of the antenna and other electronic elements on the system circuit board of the mobile communication device. Besides, the two operating bands of the antenna may cover the three-band LTE700/GSM850/900 operation (from about 704 MHz to 960 MHz) and the five-band GSM1800/1900/UMTS/LTE2300/2500 operation (from about 1710 MHz to 2690 MHz), respectively, thereby covering operating bands of all mobile communication systems at present.

While the present invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

Those skilled in the art will readily observe that numerous modifications and alterations of the device and method may be made while retaining the teachings of the invention.

What is claimed is:

1. A mobile communication device having an antenna structure, the antenna structure comprising:

a grounding element; and an antenna element, disposed in one side of the grounding element, the antenna element comprising:

an antenna ground plane, electrically connected to the grounding element;

a radiation portion, disposed on a substrate, the radiation portion comprising:

a signal feeding point, disposed on one end close to the grounding element; and a first radiation section and a second radiation section, wherein the first and second radiation sections are connected to the signal feeding point, and open ends of the first and second radiation sections are extended toward the same direction; and a shorted radiation portion, disposed on the substrate, a first end of the shorted radiation portion being electrically connected to the antenna ground plane, and a second end of the shorted radiation portion being an open end, wherein there is a coupling gap between a designated section of the shorted radiation portion close to the first end and the radiation portion, and through the coupling gap, the shorted radiation portion is capacitively excited by radiation portion and generates at least one resonant mode to increase an operating bandwidth of the antenna element;

wherein the antenna element is a three-dimensional structure, and the antenna ground plane and the radiation portion are located on different planes of the three-dimensional structure;

wherein an extended direction of the first radiation section of the radiation portion keeps the open end of the first radiation section away from the antenna ground plane, and an extended direction of the second radiation section of the radiation portion keeps the open end of the second radiation section away from the antenna ground plane.

2. The mobile communication device according to claim 1, wherein the antenna element comprises a first operating bandwidth and a second operating bandwidth, the first operating bandwidth covers from about 704 MHz to 960 MHz, and the second operating bandwidth covers from about 1710 MHz to 2690 MHz.

3. The mobile communication device according to claim 1, wherein the grounding element comprises a main ground and at least one protruded ground, the protruded ground is electrically connected to an edge of the main ground, and the protruded ground is close to the antenna ground plane.

4. The mobile communication device according to claim 3, wherein the protruded ground is used for accommodating an electronic element functioning as a data transmission port of the mobile communication device.

5. The mobile communication device according to claim 1, wherein the coupling gap is less than 3 mm.

6. The mobile communication device according to claim 1, wherein the antenna ground plane comprises a first antenna ground sub-plane and a second antenna ground sub-plane located on two adjacent sides of the antenna element, respectively.

7. A mobile communication device having an antenna structure, the antenna structure comprising:

a grounding element; and an antenna element, disposed in one side of the grounding element, the antenna element comprising:

an antenna ground plane, electrically connected to the grounding element;

a radiation portion, disposed on a substrate, the radiation portion comprising:

a signal feeding point, disposed on one end close to the grounding element; and a first radiation section and a second radiation section, wherein the first and second radiation sections are connected to the signal feeding point, and open ends of the first and second radiation sections are extended toward the same direction; and a shorted radiation portion, disposed on the substrate, a first end of the shorted radiation portion being electrically connected to the antenna ground plane, and a second end of the shorted radiation portion being an open end, wherein there is a coupling gap between a designated section of the shorted radiation portion close to the first end and the radiation portion, and through the coupling gap, the shorted radiation portion is capacitively excited by radiation portion and generates at least one resonant mode to increase an operating bandwidth of the antenna element;

wherein the antenna element is a three-dimensional structure, and the antenna ground plane and the radiation portion are located on different planes of the three-dimensional structure;

wherein a first length of the first radiation section is smaller than a second length of the second radiation section, and the first radiation section and the second radiation section provide two resonant paths with different lengths and extended toward the same direction in order to generate at least two resonant modes to increase the operating bandwidth of the antenna element.

8. The mobile communication device according to claim 7, wherein a length of the shorted radiation portion is at least twice the first length of first radiation section.

9. The mobile communication device according to claim 1, wherein the shorted radiation portion comprises a plurality of bends.

10. The mobile communication device according to claim 1, wherein the radiation portion and the shorted radiation portion of the antenna element are located on a first plane, the antenna ground plane is located on a second plane perpendicular to the first plane, and the grounding element is located on a third plane being parallel to the first plane and perpendicular to the second plane.

11. An antenna structure, comprising:

a grounding element; and an antenna element, disposed in one side of the grounding element, the antenna element comprising:

an antenna ground plane, electrically connected to the grounding element;

a radiation portion, disposed on a substrate, the radiation portion comprising:

a signal feeding point, disposed on one end close to the grounding element; and a first radiation section and a second radiation section, wherein the first and second radiation sections are connected to the signal feeding point, and open ends of the first and second radiation sections are extended toward the same direction; and a shorted radiation portion, disposed on the substrate, a first end of the shorted radiation portion being electrically connected to the antenna ground plane, and a second end of the shorted radiation portion being an open end, wherein there is a coupling gap between a designated section of the shorted radiation portion close to the first end and the radiation portion, and through the coupling gap, the shorted radiation portion is capacitively excited by radiation portion and generates at least one resonant mode to increase an operating bandwidth of the antenna element;

wherein the antenna element is a three-dimensional structure, and the antenna ground plane and the radiation portion are located on different planes of the three-dimensional structure;

wherein an extended direction of the first radiation section of the radiation portion keeps the open end of the first radiation section away from the antenna ground plane, and an extended direction of the second radiation section of the radiation portion keeps the open end of the second radiation section away from the antenna ground plane.

12. The antenna structure according to claim 11, wherein the antenna element comprises a first operating bandwidth and a second operating bandwidth, the first operating bandwidth covers from about 704 MHz to 960 MHz, and the second operating bandwidth covers from about 1710 MHz to 2690 MHz.

13. The antenna structure according to claim 11, wherein the grounding element comprises a main ground and at least one protruded ground, the protruded ground is electrically connected to an edge of the main ground, and the protruded ground is close to the antenna ground plane.

14. The antenna structure according to claim 11, wherein the coupling gap is less than 3 mm.

15. The antenna structure according to claim 11, wherein the antenna ground plane comprises a first antenna ground sub-plane and a second antenna ground sub-plane located on two adjacent surfaces of the antenna element, respectively.

16. An antenna structure, comprising:

a grounding element; and an antenna element, disposed in one side of the grounding element, the antenna element comprising:

an antenna ground plane, electrically connected to the grounding element;

a radiation portion, disposed on a substrate, the radiation portion comprising:

a signal feeding point, disposed on one end close to the grounding element; and a first radiation section and a second radiation section, wherein the first and second radiation sections are connected to the signal feeding point, and open ends of the first and second radiation sections are extended toward the same direction; and a shorted radiation portion, disposed on the substrate, a first end of the shorted radiation portion being electrically connected to the antenna ground plane, and a second end of the shorted radiation portion being an open end, wherein there is a coupling gap between a designated section of the shorted radiation portion close to the first end and the radiation portion, and through the coupling gap, the shorted radiation portion is capacitively excited by radiation portion and generates at least one resonant mode to increase an operating bandwidth of the antenna element;

wherein the antenna element is a three-dimensional structure, and the antenna ground plane and the radiation portion are located on different planes of the three-dimensional structure;

wherein a first length of the first radiation section is smaller than a second length of the second radiation section, and the first radiation section and the second radiation section provide two resonant paths with different lengths and extended toward the same direction in order to generate at least two resonant modes to increase the operating bandwidth of the antenna element.

17. The antenna structure according to claim 16, wherein a length of the shorted radiation portion is at least twice the first length of first radiation section.

18. An antenna structure, comprising:

a grounding element; and an antenna element, disposed in one side of the grounding element, the antenna element comprising:

an antenna ground plane, electrically connected to the grounding element;

a radiation portion, disposed on a substrate, the radiation portion comprising:

a signal feeding point, disposed on one end close to the grounding element; and a first radiation section and a second radiation section, wherein the first and second radiation sections are connected to the signal feeding point, and open ends of the first and second radiation sections are extended toward the same direction; and a shorted radiation portion, disposed on the substrate, a first end of the shorted radiation portion being electrically connected to the antenna ground plane, and a second end of the shorted radiation portion being an open end, wherein there is a coupling gap between a designated section of the shorted radiation portion close to the first end and the radiation portion, and through the coupling gap, the shorted radiation portion is capacitively excited by radiation portion and generates at least one resonant mode to increase an operating bandwidth of the antenna element;

wherein the antenna element is a three-dimensional structure, and the antenna ground plane and the radiation portion are located on different planes of the three-dimensional structure;

wherein the radiation portion and the shorted radiation portion of the antenna element are located on a first plane, the antenna ground plane is located on a second plane perpendicular to the first plane, and the grounding element is located on a third plane being parallel to the first plane and perpendicular to the second plane.

* * * * *